United States Patent [19]

Stumpf

[11] Patent Number: 4,930,689

[45] Date of Patent: Jun. 5, 1990

[54] RESEALABLE CAP FOR A CONTAINER

[76] Inventor: Thomas R. Stumpf, 615 Showers St., Harrisburg, Pa. 17104

[21] Appl. No.: 316,883

[22] Filed: Feb. 28, 1989

[51] Int. Cl.[5] ..... B67D 3/00

[52] U.S. Cl. ..... 222/487; 137/588; 222/484; 222/518

[58] Field of Search ..... 222/487, 484, 518, 481.5, 222/482, 483, 488; 137/588

[56] References Cited

U.S. PATENT DOCUMENTS

| | | | |
|---|---|---|---|
| 553,389 | 1/1896 | Brower | 137/588 X |
| 1,805,257 | 5/1931 | Pitt | 222/518 |
| 2,197,352 | 4/1940 | Terkel | 222/488 |
| 2,239,921 | 4/1941 | Majewski, Jr. | 222/487 |
| 2,337,276 | 12/1943 | Sanchis | 222/518 X |
| 2,440,112 | 4/1948 | Nellson | 222/484 |
| 2,661,018 | 12/1953 | Snyder | 137/588 |
| 2,685,978 | 8/1954 | Crockett | 222/511 |
| 2,963,205 | 12/1960 | Beall, Jr. | 222/484 |
| 3,376,582 | 4/1968 | Samuels | 222/488 |
| 3,782,602 | 1/1974 | Page | 222/518 X |
| 3,814,293 | 6/1974 | Daves | 222/185 X |
| 4,715,516 | 12/1987 | Salvail | 222/487 X |
| 4,801,053 | 1/1989 | Kaster | 222/518 X |

FOREIGN PATENT DOCUMENTS

| | | | |
|---|---|---|---|
| 235063 | 9/1987 | European Pat. Off. | 222/484 |
| 2608722 | 6/1988 | France | 222/484 |

*Primary Examiner*—Kevin P. Shaver

[57] ABSTRACT

A cap for a gas pressurized container, adapted to maintain the pressure therein. The cap includes an insert which forms a seal between the exterior surface of the insert and the opening in the bottle. Disposed inside the insert is a valve which forms a seal between the interior of the insert and the interior of the bottle. A spring urges the valve away from the interior of the bottle to a closed position. The valve is opened by depressing a button on the outside of the cap. The gas pressure in the container urges the valve outward to perfect the seal. The cap may be used in any context wherein a gas tight seal is desired.

2 Claims, 3 Drawing Sheets

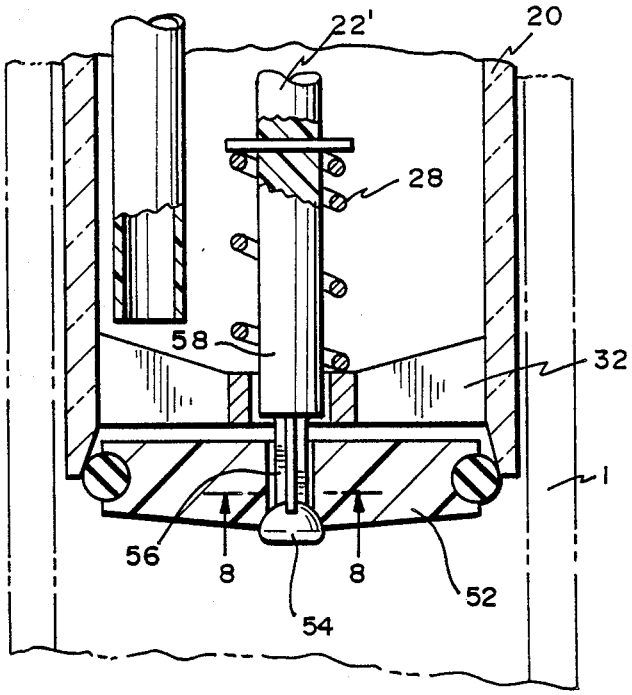
FIG. 5
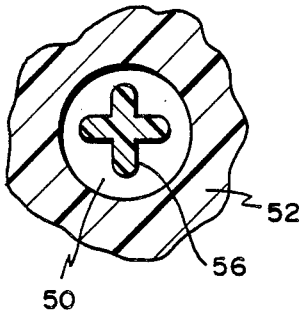
FIG. 8
FIG. 6
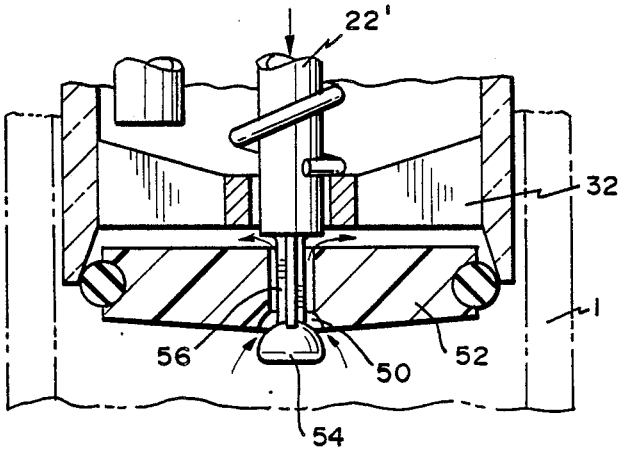
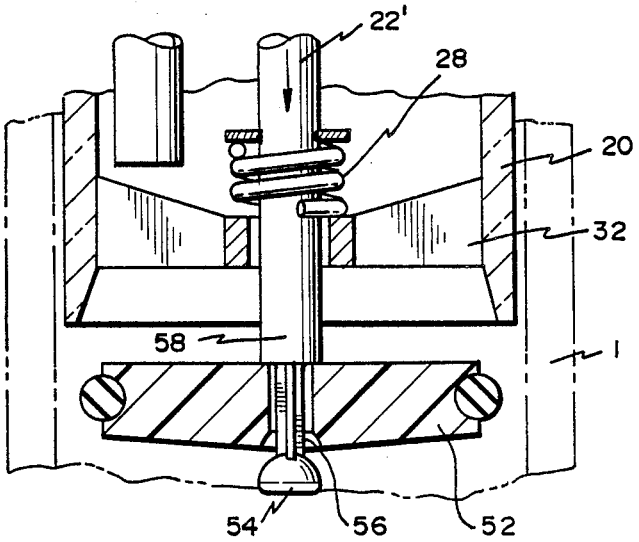
FIG. 7

RESEALABLE CAP FOR A CONTAINER

FIELD OF THE INVENTION

This invention is directed to a resealable cap for a container, and in particular to a resealable cap to maintain the carbonation of a beverage in the container. However, the resealable cap of the invention is useful in many other contexts wherein a seal is desired between the interior and exterior of a container.

BACKGROUND OF THE INVENTION

Carbonated beverages have long been available in bottles of volumes of up to 3 liters, quantities which are not generally consumed at a single sitting. Although it may be economical to purchase beverages, e.g., soft drinks, in such large bottles, opening the bottle and resealing it by hand will very often result in an imperfect seal which will cause the liquid to go "flat", i.e., lose its carbonation to the atmosphere.

The most common type of top for soft drink bottles in use today is a screw top made of stamped aluminum with a plastic insert. At the bottling plant, the aluminum cap is generally sealed around the opening in the bottle by means of bendable tabs or a frangibly-connected ring around the rim of the cap. To permit the cap to be removed, when the cap is first unscrewed from the bottle by the consumer, either the bendable tabs will deform to form a larger diameter at the base of the cap, or the frangibly-connected ring will break off the cap and remain around the neck of the bottle. If the contents of the bottle are not entirely consumed at once, the consumer will naturally want to reseal the bottle with the original cap. The original cap, however, will not be able to effect the efficient seal created at the bottling plant after the bottom tabs have been distended or the connecting ring has been broken off. Consequently, no matter how tightly the consumer tries to reattach the bottle cap, the carbonation gases will escape from the soft drink through the imperfect seal, leaving the beverage flat.

The engineering problems associated with maintaining carbonation of a liquid in a container are identical to those of the general problem of maintaining a gaseous seal between the interior and exterior of a container. Thus, although the present invention is primarily intended to maintain carbonation in a bottle, the apparatus may be used in a variety of contexts where gaseous interchange between the interior and exterior of a bottle is to be avoided. For example, a non-carbonated liquid which gives off harmful fumes, such as turpentine, may be inoffensively but conveniently stored in a container incorporating the present invention. The apparatus of the present invention may also be used to create a seal for containers of liquids that may easily be contaminated by bacteria, such as baby formula. And, of course, the apparatus may be used to maintain carbonation in beverages which are not soft drinks, such as beer or sparkling wine.

An object of the present invention is to provide a resealable cap which may be placed on containers which have been previously opened. The consumer, having broken the seal of the original aluminum cap, may subsequently use the reusable cap of the present invention to maintain carbonation of the liquid while it is being consumed over the course of several openings of the bottle. The present invention creates a gas tight seal between the interior of the bottle and the outside atmosphere.

Another object of the invention is to provide a reusable cap for carbonated beverage bottles which will effect a reliable seal without obliging the consumer to follow complicated directions.

Another object of the invention is to provide a reusable cap for carbonated beverage bottles, in which the integrity of the seal is maintained by the outward gaseous pressure of the carbonation itself.

Another object of the invention is to provide a reusable cap capable of maintaining a gaseous seal between the interior and exterior of a container.

Other objects will appear hereinafter.

SUMMARY OF THE INVENTION

In its broad aspects the resealable cap according to the invention comprises an insert member adapted to be inserted into an opening in the container and defining a passage from the interior to the exterior of the container, and valve means for closing the passage. Biasing means are provided for urging the valve means against the insert member and away from the interior of the container to effect a seal between the interior of the container and the passage. Valve release means are provided for selectably applying force against the biasing means for urging the valve means away from the insert member to break the seal. Body means support the insert member, valve means, biasing means and valve release means for removably attaching the cap to the container. The body means define a pour spout in communication with the passage and define an inlet means in communication with the interior of the container.

The body member includes screw threads by which the cap may be attached to the opening of the bottle. This body member further comprises a spout and an air evacuation tube. The screw threads on the body member are inwardly facing so as to engage the outwardly facing screw threads on the bottle itself, like the original cap put on the bottle at the bottling plant. Adjacent to the interior surface of the bottle opening is a tubular member. The combination of the body and the tubular member is sealed around the rim of the bottle opening by means of an O-ring, or equivalent sealing means.

The insert member is a hollow cylinder with one end opening towards the interior of the bottle and the other end opening towards the spout and air evacuation tube of the body member. Disposed within this hollow cylinder is a valve means which comprises a plunger and a sealing member. The sealing member is adapted to fit either within the interior surface or at the internally facing rim of the tubular member, thus being able to effect a seal between the interior of the bottle in general and the interior of the insert member. This seal may be effected by means of an O-ring situated between the sealing member and the interior of the insert member. This sealing member is connected to a plunger which is disposed along the length of the insert member and which emerges through a close-fitting hole in the top of the body member and terminates in a button. Thus, by pushing the button in the top of the body member, the plunger is depressed and the seal between the sealing member and the interior surface of the insert member is opened.

In its closed position, the plunger is urged upward by means of a spring, thus causing the connected sealing member to be urged against either the rim of or the interior surface of the insert member. This spring is disposed generally around the plunger where one end of the spring engages a retaining washer rigidly fixed to the plunger approximately at the mid-point of the plunger, and the other end of the spring engages a guide means rigidly attached to the interior of the insert member. The guide means serve both to hold the plunger in a generally central position within the tubular member and to provide a place against which the compression spring can press. Situated between the guide means, which is rigidly attached to the insert member, and the retaining washer, which is rigidly connected to the plunger, this spring will provide a constant force by which the plunger is pushed upwards, thereby pushing the sealing member against an interior surface or rim of the insert member.

It is a significant feature of the present invention that the direction in which the seal is urged closed is outwards, away from the interior of the bottle. This design is more effective than a design in which the sealing member is urged downwards against the interior of the bottle. Carbonated beverages have a natural outward gaseous pressure associated with them as gas inside the liquid is gradually liberated therefrom. There is thus always an outward pressure against the bottle walls and opening. In the present invention the outward pressure is in the same direction as the biasing of the sealing member against the insert member; therefore, the natural gaseous pressure of the liquid in the bottle serves to increase the efficiency of the seal.

BRIEF DESCRIPTION OF THE DRAWINGS

For the purpose of illustrating the invention, there is shown in the drawings a form which is presently preferred; it being understood, however, that this invention is not limited to the precise arrangements and instrumentalities shown.

FIGS. 5–7 show the sequence of operation of a second embodiment of the present invention.

FIG. 8 is a cross-section view through line 8—8 of FIG. 5.

DETAILED DESCRIPTION OF THE INVENTION

Figure 1:
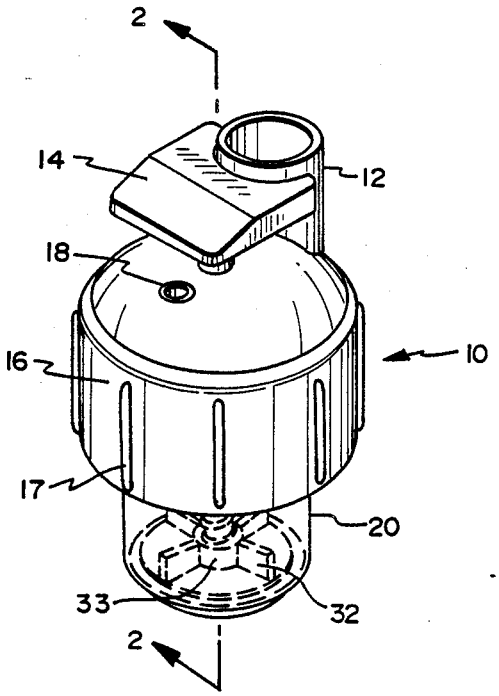
FIG. 1 is an isometric view of the apparatus of the present invention, with the mechanism of its lower portion, ordinarily not visible shown in broken lines.

In the drawings, wherein like numbers indicate like elements, there is shown in FIG. 1 an isometric view of the cap of the present invention. The cap 10 includes body member 16, which has in its top end spout 12, button 14, and ventilation opening 18. The sides of body member 16 may be provided with grip members 17, which enable the cap to be put on or taken off a bottle easily. Extending from the bottom of body member 16 is insert tube 20, which is designed to be inserted into the interior of a bottle to be sealed.

Figure 2:
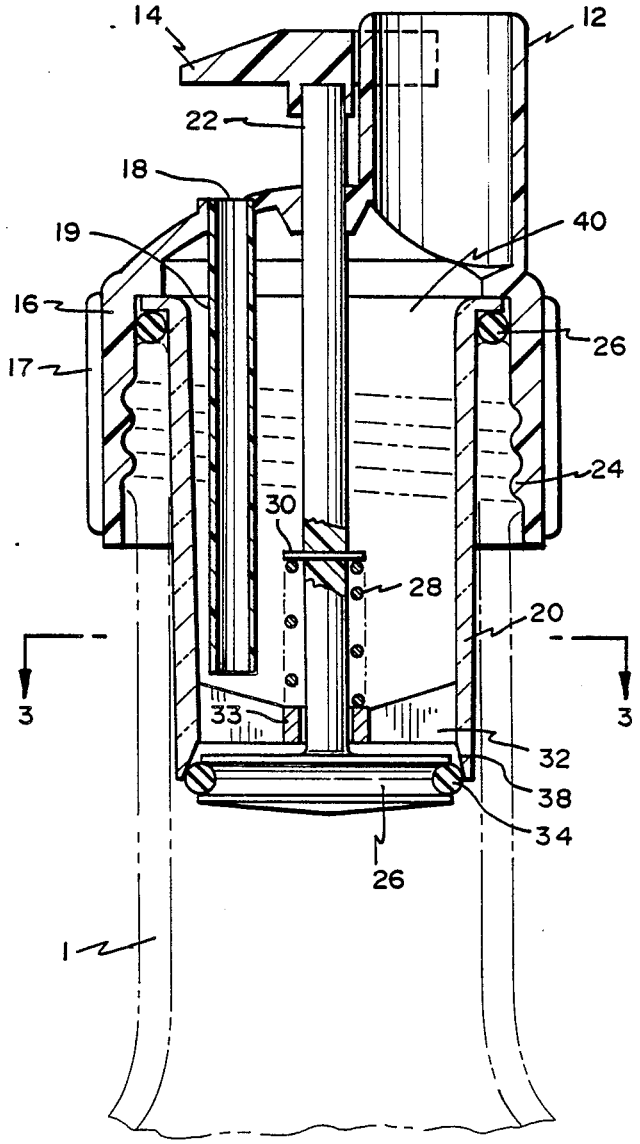
FIG. 2 is a cross-sectional view of the apparatus shown through line 2—2 of FIG. 1, showing the apparatus of the present invention mounted on a bottle.

FIG. 2 is a cross-sectional view of the cap when it is screwed on to a typical bottle 1, shown in phantom. Body member 16 has on its interior surface a plurality of screw threads 24 which engage the screw threads of the bottle. Insert tube 20 is disposed generally inside body member 16 in such a way that, when the cap 10 is screwed onto a bottle, the interior surface of body member 16 engages the outside of the bottle while the exterior surface of the insert tube 20 is generally contiguous with the interior surface of the bottle. Insert tube 20 extends down some distance into the bottle and terminates in a sealing means 26, which is operatively connected through plunger 22 to button 14. Insert tube 20, valve means 26, and the top of body member 16 define a substantially closed space 40. Spout 12 forms a communication between the closed space 40 within cap 10 and the outside air, as do ventilation opening 18 and ventilation tube 19. In its closed position, valve means 26 forms a seal between the interior of the bottle and the enclosed space within cap 10, in a way which will be described in greater detail below.

Figure 3:
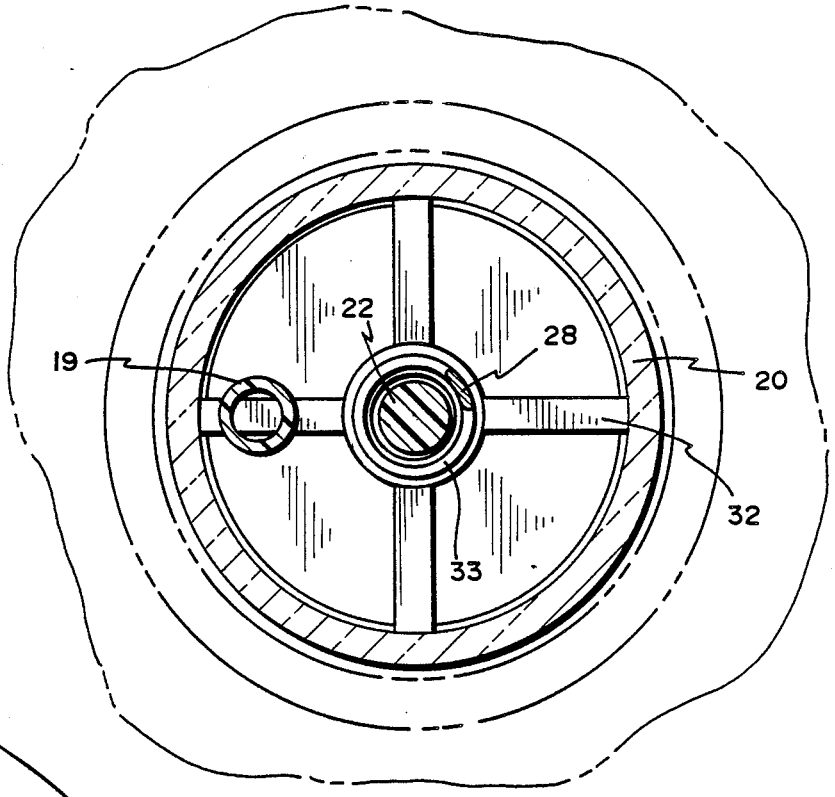
FIG. 3 is a cross-sectional view of the apparatus shown through line 3—3 of FIG. 2.

Button 14 at the top of the cap is attached to a plunger 22, which is in the form of an elongated member which passes through the top of the cap, through the insert tube 20, and terminates in a sealing member 26. Sealing member 26 is a substantially disc shaped member which conforms to the lower end of insert tube 20, forming a closure between the interior of the insert tube and the interior of the bottle. The plunger 22 is normally urged upwards, away from the interior of the bottle, by a compression spring 28. Compression spring 28 engages at its top end a retaining washer 30, which is fixedly attached around the plunger 22. The bottom end of the compression spring 28 engages a guide means comprising projections **32*a*, 32*b*, 32*c* and 32*d* (more clearly seen in FIG. 3), and guide cylinder 33. The projections 32*a*, 32*b*, 32*c* and 32*d* project from the interior surface of insert tube 20 where they support guide cylinder 33, which fits around plunger 22 and serves to hold it in a generally central position within the insert tube 20. Compression spring 28 pushes against the retaining washer 30 and the guide cylinder 33, pushing plunger 22 upwards, and urging the edges of sealing member 26 against the interior surface of insert means 20. In this way, a seal is effected between the edge of sealing member 26 and the interior of the insert tube 20**.

Figure 4:
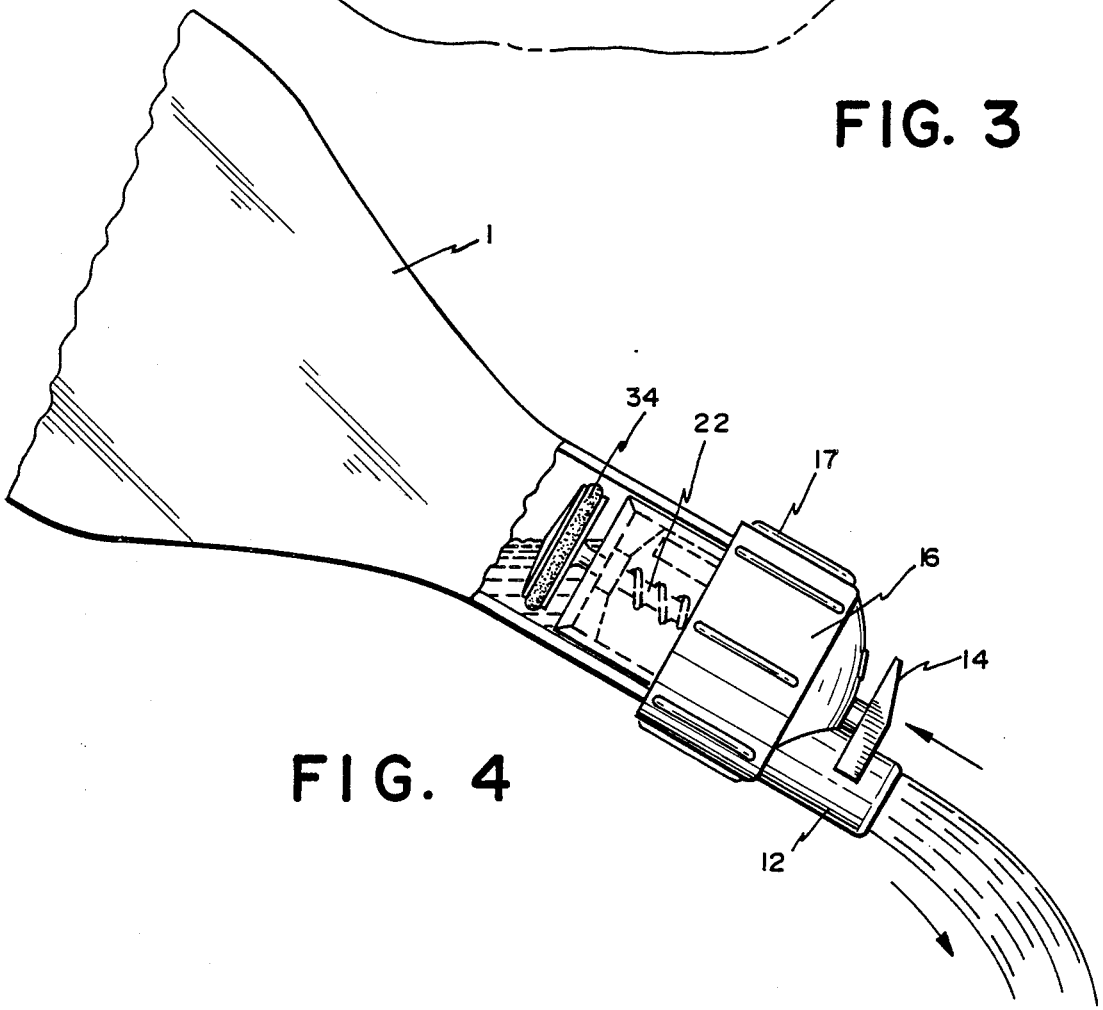
FIG. 4 is a partial cross-section view of the apparatus, shown in use to pour a liquid from a bottle.

In operation, the user pushes down button 14, pushing down plunger 22 against the force of compression spring 28. The lowering of plunger 22 separates sealing member 26 from the rim of the insert tube 20, creating an opening between the interior of the bottle and the interior of the insert tube 20. FIG. 4 shows how the opening thus formed allows for pouring of carbonated liquid from the bottle. Liquid may pass through this opening, through the insert tube 20 and out spout 12. When the user is finished pouring from the bottle he releases button 14, and spring 28 again urges the sealing member against the interior of the insert tube, re-forming a seal.

Body member 16 further comprises means for allowing the replacement of air as liquid is poured out of the bottle. This means comprises ventilation opening 18, which opens into ventilation tube 19. When liquid is being poured out of the bottle, as in FIG. 4, the space left by the removed liquid may be replaced by air passing back into the bottle through ventilation tube 19, thus avoiding splashing and allowing for efficient pouring.

In order to allow for a more efficient seal, the invention may incorporate O-rings at the junction of the top of the bottle and the body means 16 (O-ring 34), and at the junction between the sealing member 26 and the interior of the insert tube 20 (O-ring 36). In the preferred embodiment these O-rings are made out of black neoprene, but any suitably smooth and compressible material may be used. O-ring 36 may engage a bevel 38 in the insert tube, so as to provide a surface against which the O-ring 36 may securely be urged without sliding up the interior surface of insert tube 20.

It has been found that, under certain conditions, pressures within a carbonated beverage bottle can approach 90 pounds per square inch. Under these conditions, the upward pressure against sealing member 26, and thus button 14, causes opening of the seal to become very difficult. A user trying to press down on button 14 will have to overcome a substantial force in the opposite direction caused by the upward gas pressure within the bottle.

In order to circumvent this problem, a second embodiment of the present invention includes a pressurerelease mechanism at the junction of sealing member 26 and plunger 22. In this embodiment, illustrated in FIGS. 5-7, the plunger and sealing member are separate pieces, not molded out of a single piece as in the previous embodiment.

As can be seen in FIG. 5, plunger 22' is at its bottom end threaded through an opening 50 in sealing member 52. Plunger 22' at its bottom end terminates in a mushroom shaped tip 54, larger in diameter than opening 50. Tip 54 forms a seal around opening 50 when the plunger 22' is urged upwards by spring 28. Between tip 54 and the body of plunger 22', in the region of plunger 22' which is threaded through opening 50, there is a reduced diameter plunger portion 56, which preferably has an X-shaped cross section, as seen in FIG. 8. The reason for this X-shaped cross section is that gas must be allowed to pass between reduced diameter portion 56 and the edges of opening 50 when the plunger 22 is depressed slightly and tip 54 is disengaged from the rim of opening 50. Thus, at the beginning of a downward push of plunger 22', tip 54 will separate slightly from the rim of opening 50 and allow pressure from interior of the bottle to escape between the edge of opening 50 and narrow region 56. The purpose of this pressure release is to ventilate the high pressure pushing upwards against sealing member 52. This brief period of ventilation before the opening of the valve itself makes the downward movement of the plunger 22' much easier.

FIG. 6 shows the valve means when the valve begins to be opened. When the plunger 22' is first pushed down, tip 54 will disengage from the lower rim of opening 50. The reduced diameter portion 56 is of such a length that for a brief period there will be a clear passageway over tip 54 around narrow region 56, going right through opening 50. During this period, the extreme pressure within the bottle will be ventilated, as shown by the arrows in FIG. 6.

FIG. 7 shows the valve means when the plunger 22' is pushed down further. As plunger 22' moves further down, shoulders 58 on plunger 22' will engage the top rim of opening 50 in sealing member 52, so that continued downward movement of plunger 22 will push sealing member 52 away from the rim of body member 20, thus opening the seal and allowing passage of liquid in exactly the same manner as in the previous embodiment. Because tip 54 is of small surface area, it does not have as much upward pressure on it as sealing member 26 in the previous embodiment would, and thus it is easier to push down the plunger on a carbonated beverage using this second embodiment.

The present invention may be embodied in other specific forms without departing from the spirit or essential attributes thereof and, accordingly, reference should be made to the appended claims, rather than to the foregoing specifications, as indicating the scope of the invention.

I claim:

1. A resealable cap for a container, comprising:

an insert member adapted to be inserted into an opening in said container, defining a passage from the interior to the exterior of the container;

valve means for closing the passage, said valve means having;

(a) a sealing member, having an opening therethrough surrounded by a rim and having an edge substantially contiguous with the edge of said passage;

(b) an elongated member disposed within said insert member, having a first end having a tip attached to said elongated member by a reduced diameter portion, said tip and said reduced diameter portion being configured to permit said reduced diameter portion to pass through said opening in said sealing member; said first end of said elongated member and said opening in said sealing member being configurated to co-act with said tip to form a seal around the rim of said opening in said sealing member when said elongated member is urged away from the interior of said container; said first end of said elongated member and said opening in said sealing member being shaped to define a gas passage in the space between said narrow portion and the rim of said opening in said sealing member when said elongated member is pushed a predetermined distance toward the interior of said container; said elongated member adapted to engage and push said sealing member toward the interior of said container when said elongated member is pushed toward the interior of said container more than a predetermined distance, thereby separating said substantially contiguous edge of said sealing member from said insert member; said elongated member having a second end disposed external to said container and said insert member;

(c) biasing means adapted to urge said elongated member and sealing means away from the interior of said container to effect a seal between the interior of said container;

said valve means being configured for opening said seal by application of a mechanical force against said elongated member in a direction opposite that of said biasing means; and body means adapted to removably attach said insert member to said container, said body means comprising a pour spout and means for air replacement within said container.

2. A pressure relief valve for a pressurized container, comprising:

(a) a primary sealing member for sealing the container;

(b) a pressure relief opening, surrounded by a rim, in the primary sealing member;

(c) an elongated member having a first end having a tip attached to said elongated member by a reduced diameter portion, said tip and said reduced diameter portion being configured to permit said reduced diameter portion to pass through said pressure relief opening in said sealing member; and (d) means for urging said elongated member away from the interior of said container;

said first end of said elongated member and said pressure release opening in said sealing member being configured to co-act with said tip to form a seal around the rim of said opening in said sealing member when said elongated member is urged away from the interior of said container; said first end of said elongated member and said opening in said sealing member being shaped to define a gas passage in the space between said narrow portion and the rim of said opening in said sealing member when said elongated member is pushed a predetermined distance toward the interior of said container; said elongated member adapted to engage and push said sealing member toward the interior of said container when said elongated member is pushed toward the interior of said container more than said predetermined distance, thereby separating said sealing member from said container; said elongated member having a second end disposed external to said container.

* * * * *